US005253387A

United States Patent [19]

Kresse et al.

[11] Patent Number: 5,253,387

[45] Date of Patent: Oct. 19, 1993

[54] MOP HEAD WITH TWO POUCHES AND A STRAP

[75] Inventors: Franz Kresse, Hilden; Rainer Osberghaus, Duesseldorf; Bernfried Scheller, Pulheim; Roland Schunter, Lorch-Waldhausen, all of Fed. Rep. of Germany

[73] Assignee: Henkel Kommanditgesellschaft auf Aktien, Duesseldorf-Holthausen, Fed. Rep. of Germany

[21] Appl. No.: 856,213

[22] PCT Filed: Nov. 2, 1990

[86] PCT No.: PCT/EP90/01833

§ 371 Date: Jul. 13, 1992

§ 102(e) Date: Jul. 13, 1992

[87] PCT Pub. No.: WO91/07130

PCT Pub. Date: May 30, 1991

[30] Foreign Application Priority Data

Nov. 13, 1989 [DE] Fed. Rep. of Germany ..... 3937717

[51] Int. Cl.[5] ..... A47L 13/10; A47L 13/16; A47L 13/255

[52] U.S. Cl. ..... 15/228; 15/147.2; 15/229.8

[58] Field of Search ..... 15/228, 229, 229.4, 15/229.8, 229.3, 229.7, 119.1, 120.1, 120.2, 147.2

[56] References Cited

U.S. PATENT DOCUMENTS 2,987,745 6/1961 Ballinger ..... 15/229.8
4,680,826 7/1987 Schunter ..... 15/229.8
4,914,778 4/1990 Thompson ..... 15/229.4
4,961,242 10/1990 Kresse et al. ..... 15/228

FOREIGN PATENT DOCUMENTS 0305031 3/1989 European Pat. Off. ..... 15/228
2611615 9/1977 Fed. Rep. of Germany ..... 15/229.8
3246161 6/1988 Fed. Rep. of Germany .
3823456 7/1989 Fed. Rep. of Germany ..... 15/228

*Primary Examiner*—Harvey C. Hornsby
*Assistant Examiner*—Tony G. Soohoo
*Attorney, Agent, or Firm*—Ernest G. Szoke; Wayne C. Jaeschke; Kenneth Watov

[57] ABSTRACT

In a mop head which can be fitted on a mop holder having two flaps which can be folded back upon each other, with the mop head including two pouches on its upper side, and an additional securing device allocated to one pouch, a system is provided to facilitate the securing of the strap to the end of the flap in the locked position of use. This is achieved in that the securing device is a strap or retaining plate having two elongated holes or slots, the plate being fitted to a fabric covering of the mop head at its short end, with screw-head-like projecting securing means corresponding to the elongated holes on one of the flaps, whereby the elongated holes have a longitudinal extension permitting insertion in the pouch and the release of the flap end from the pouch, on the relative movement of the flap and strap, and the securing means lie against the edge of the elongated hole towards the short end with the mop head secured in the operative position, and lie against the edge of the elongated hole towards the handle when the flaps are folded.

10 Claims, 1 Drawing Sheet

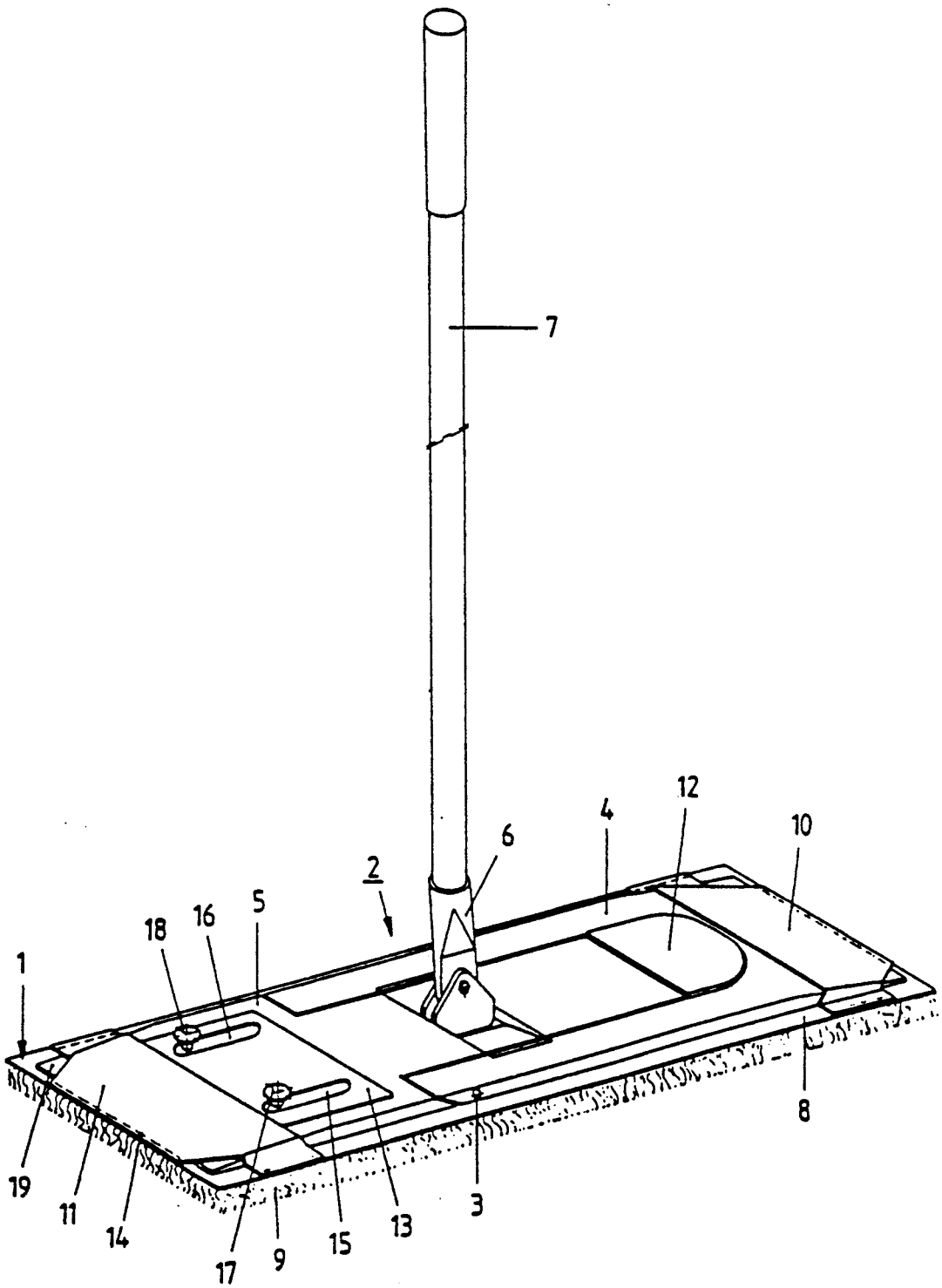
7
12
4
10
6
2
5
16
18
1
8
19
11
14
17
9
15
13
3

MOP HEAD WITH TWO POUCHES AND A STRAP

BACKGROUND

1. Field of the Invention

This invention relates generally to a mop head for the wet or damp wiping of floors, and more specifically to such mop heads designed to be fitted onto a mop holder comprising two flaps, these flaps being designed to snap together from a locked working position.

2. Discussion of Related Art

Mop heads and mop holders of the type in question are used for institutional room and floor care.

One such prior mop head, for example, is shown in DE-PS 32 46 161. This mop head has two receiving pockets for the mop holder on its upper surface, and an additional fastening element on one of the pockets. The additional fastening element is fixed on one side in the bottom of the pocket and, on the opposite side, comprises means by which it can be releasably fixed around the U-shaped end of a flap of the mop holder. In the locked working position of the mop holder, the additional fastening element is pushed into the associated pocket from the end of the flap and the damp wiping mop is inserted in the two end pockets and used as such for floor cleaning. To wash and squeeze out the mop head, the two flaps snap together from their locked working position so that their two ends come free from the pockets. The damp wiping mop fixed lengthwise to the fixing plate then hangs down from a flap. After it has been washed and, optionally, squeezed out, the damp mop head is placed on the floor and the flap ends are reinserted into the pockets until the locked working position is reached. The entire process of washing and squeezing out is said to be carried out in such a way that the user does not have to lay a hand on the mop head.

This known mop head has the disadvantage that the additional fixing plate is secured to the end of the flap of the mop holder and, when this end of the flap is inserted into the associated pocket, always has to be fully inserted therewith into the pocket. In many cases, the result of this is that the fixing plate twists or bends over and blocks the pocket opening, i.e. the end of the flap can only be inserted with difficulty and extra force. This known mop head also has the disadvantage that the additional fixing plate can only be secured to the end of the flap when it is not inserted into the pocket. This makes the mop head difficult to handle insofar as, to secure the mop head, the mop holder first has to be brought into the locked working position. The additional fixing plate is then fastened to one end of a flap of the mop holder. However, since the mop holder cannot be inserted into the pockets in this locked working position, the mop holder has to be unlocked again so that the ends of the flaps can be inserted into the pockets and the mop holder brought into the working position.

SUMMARY OF THE INVENTION

An object of the invention is to provide a solution for enabling the fixing plate to be secured to the end of the flap in the locked working position, while requiring a shorter fixing plate by comparison with known mop heads.

In a mop head of one embiment of the invention, the fastening means consists of a fixing plate formed with two slots and fixed at its longitudinal end to a textile layer and fastening elements projecting like screw heads corresponding to the slots are arranged on one of the flaps made entirely of plastic, the slots having a length through relative displacement of the flap and fixing plate, for enabling the flap end to be inserted into the pocket and to be released from the pocket, with the fastening elements bearing against the longitudinal-end slot boundary when the mop head is locked in the working position, and bearing against the slot boundary facing the handle when the flaps are in the unlocked position.

The invention permits use of a fixing plate shorter than used in the prior art. Since the fixing plate is secured to, the end of the flap in the prior art, it has to be made long enough to be placed around the U-shaped end of the flap, and also enables the end of the flap to be fully inserted into the pocket. In practice, this means that the length of the additional fastening element is more than twice the depth of the pocket. According to the invention, however, the length of the fixing plate need only correspond substantially to the depth of the pocket. This means a saving of material in relation to the prior art. According to one embodiment of the invention, the relative displacement between the flap and the fixing plate or between the flap and the pocket is determined by the slots and the fastening elements of the plastic flap displaceable therein.

In addition, the design of the fixing plate according to the invention also enables the fixing plate to be secured to the mop holder even when it is inserted in the pocket. Although this is also possible with the mop head and mop holder according to DE-OS 34 17 178, the relative displacement between the pockets and the ends of the flap in this prior art takes place through unfolding additional fastening elements. The intended saving of material by the invention cannot be achieved with this known construction.

In a preferred embodiment of the invention, the fixing plate is naturally rigid enough to facilitate the relative displacement.

Finally, since the mop head may come into contact with aggressive cleaning products, and since the fixing plate is at least locally flexible, the fixing plate in another embodiment of the invention is made of plastic, more particularly a thermoplastic based on polyether esters.

BRIEF DESCRIPTION OF THE DRAWINGS

The invention is described with reference to the accompanying drawing in which the sole Figure shows one embodiment of the present mop head.

DETAILED DESCRIPTION OF THE INVENTION

The sole Figure shows a mop head 1 for the wet or damp wiping of floors. The mop head 1 is fitted onto a mop holder globally denoted by the reference 2, which is shown in the locked working position. The mop holder 2 consists of two flaps 4 and 5 designed to snap together about an axis 3, and a preferably universally secured handle mount 6 with a handle 7 inserted therein. The mop head 1 consists of an elongate textile layer 8 adapted to the shape of the flaps 4,5. Mop fringes 9 are arranged on bottom of the textile layer 8. Pockets 10 and 11 are fixed to the top of the text layer 8 at both longitudinal ends thereof. The pockets 10,11 are stitched onto the top of the textile layer 8 both at the longitudinal sides and at the transverse sides. To unlock the mop holder 2 from the illustrated working position, a foot key 12 has to be actuated. A fixing plate 13 is secured in one of the pockets 10, 11 of the mop head 1 (in the pocket 11 in the illustrated embodiment) as an additional fastening means. The fixing plate 13 is stitched together with the pocket 11 to the longitudinal edge of the mop head 1 by means of a seam 14. Slots 15 and 16 are formed in the fixing plate 13 outside the area covered by the pocket 11. In the illustrated position of the mop head 1 secured to the flap 5, fastening elements 17 and 18 form projecting like screw heads from the flap 5 which are arranged for displacement in the slots 15 and 16. The fastening elements 17 and 18 are integral with the flap 5. They are inserted into the slots 15 and 16 by "threading". The head part of the fastening elements 17 and 18, which widens in the manner of a screw head, prevents them from slipping out from the slots 15 and 16 while allowing relative displacement between the flap 5 and the fixing plate 13 or the pocket 11. The slots 15 and 16 are of such a length that, in the event of displacement of the fastening elements 17 and 18 from the position shown in the Figure into the stop position against the slot boundaries facing the handle mount 6, the end 19 of the flap is released from the pocket 11. In other words, when the mop head 1 or rather the fixing plate 13 is fixed to the flap 5, the fastening elements 17 and 18 bear against the longitudinal-end slot boundaries with the flap inserted into the pocket 11, as shown in the Figure; when the end 19 of the flap is released from the pocket, the fastening elements 17 and 18 bear against the slot boundaries facing the handle 7. The fixing plate 13 is preferably made of plastic and is naturally rigid enough to allow relative displacement of the fastening elements 17 and 18 in the slots 15, 16.

The fixing plate 13 is made of a thermoplastic based on polyether esters. The thermoplastic is partly crystalline and is marketed under the name of Arnitel ®.

When the mop head 1 and the mop holder 2 are to be used, the two flaps 4 and 5 may be inserted into the pockets 10 and 11 and the mop holder 2 is brought into the locked working position illustrated. The fixing plate 13 is then threaded onto the fastening elements 17, 18. In this position, the mop head 1 ready for use.

To wash out or squeeze out the mop head 1, the foot key 12 is actuated to unlock the mop holder 2. When the handle 7 is lifted up, the flaps 4 and 5 snap together so that their ends are released from the pockets. During this movement, the fastening elements 17, 18 in the slots 15 and 16 move from the illustrated position into the stop position against the opposite slot boundaries. In this position (not shown), the damp wiping mop hangs lengthwise from the flap 5 and can be placed in wash buckets and presses. After the mop head 1 has been washed and squeezed out it is placed back on the floor depending from the flap 5 and the ends of the flap are inserted into the pockets 10 and 11. The fastening elements 17, 18 then move from the stop position (not shown) into the illustrated stop position in the slots 15, 16.

The described mop head may be modified or amplified in various ways without departing from the basic concept of the invention, which modifications are meant to be covered by the spirit and scope of the appended claims. For example, the fixing plate 13 with its two slots may be replaced by two strip-like fixing plates each formed with one slot. In addition, the pocket 11 and the fixing plate 13 may be made in one piece. In this case, the fixing plate 13 forms an extension of the pocket 11 which is stitched to the top of the textile layer 8. The fixing plate 13 is thus not stitched to the textile layer.

What is claimed is:

1. A mop for wet or damp wiping of floors, comprising:

a mop holder including:

first and second flaps of substantially rectangular shape, and having a top surface and a bottom surface, respectively, and outer and inner ends, respectively;

handle receptacle means located between said inner ends of said first and second flaps, for securing an end of a handle to said mop;

means for mounting said first and second flaps with respective inner ends juxtaposed below said handle receptacle means, for providing both a working position in which said first and second flaps lie in substantially the same horizontal plane, and a non-working position in which said first and second flaps fold together with respective bottom surfaces in opposition to one another, with said mop held above a floor; and fastening means on said top surface of said first flap, and for securing a mop head thereto; and a mop head including:

a rectangular fabric layer having a top surface and a bottom surface, being dimensioned to be slightly larger than a rectangular configuration of said first and second flaps of said mop holder in the working position, also having mop fringes attached to said bottom surface, first and second pockets formed on its top surface at opposing first and second horizontal ends, respectively, said first and second pockets having openings facing inward toward an opposing second and first ends, respectively;

a rigid mounting plate dimensioned at one end portion to fit within said first pocket, with a leading edge of this portion being rigidly secured together with and between leading edges of said first pocket and said first longitudinal end of said fabric layer, another end portion of said mounting plate being free and extending away from said first pocket a predetermined distance, with a pair of longitudinal open slots through said mounting plate, spaced apart from and parallel to one another, proximate associated side edges of said mounting plate, said slots being adapted for mating with said fastening means;

whereby said mop head is installed into said mop holder by first placing said mop holder in its non-working condition, next inserting said first flap of said mop holder into said first pocket of said mop head between said mounting plate and the top surface of said mop head, with said fastening means coacting with said slots for both securing said plate to said mop holder while allowing longitudinal movement therebetween in a range predetermined by the lengths of said slots, thereby permitting the outer end of said second flap to be inserted into said second pocket as said mop is lowered toward a floor causing said first and second flaps to move towards their said working position and said fastening means to move along said slots toward said first pocket, until said mop holder is placed in its working condition with said second flap in said second pocket, and said fastening means positioned substantially at ends of slots, respectively, closest to said first pocket.

2. A mop as claimed in claim 1, wherein said mounting plate consists of rigid material for facilitating the movement of said fastening means along the associated said slots.

3. A mop as claimed in claim 1, wherein the mounting plate of said mop head is made of plastic.

4. A mop as claimed in claim 1, wherein said flaps of said mop holder each consist of plastic material.

5. A mop as claimed in claim 1, wherein said mounting plate of said mop holder consists of a thermoplastic based on polyether esters.

6. A mop as claimed in claim 2, wherein said flaps of said mop holder each consist of plastic material.

7. A mop as claimed in claim 3, wherein said flaps of said mop holder each consist of plastic material.

8. A mop as claimed in claim 2, wherein said mounting plate of said mop head consists of a thermoplastic based on polyether esters.

9. A mop as claimed in claim 3, wherein said mounting plate of said mop head consists of a thermoplastic based on polyether esters.

10. A mop as in claim 4, wherein said plastic material is a thermoplastic based on polyether esters.

* * * * *